United States Patent [19]

Kuehnle

[11] 4,241,160

[45] Dec. 23, 1980

[54] MULTIPLE COPY ELECTROPHOTOGRAPHIC REPRODUCING METHOD

[75] Inventor: Manfred R. Kuehnle, Lexington, Mass.

[73] Assignee: Coulter Systems Corporation, Bedford, Mass.

[21] Appl. No.: 909,433

[22] Filed: May 25, 1978

Related U.S. Application Data

[63] Continuation of Ser. No. 723,098, Sep. 14, 1976, abandoned, which is a continuation of Ser. No. 517,173, Oct. 23, 1974, abandoned.

[51] Int. Cl.[3] ..... G03G 13/14

[52] U.S. Cl. ..... 430/124; 430/54; 430/87; 430/88; 430/94; 430/126

[58] Field of Search ..... 96/1 R, 1.4, 1.5; 204/192 R, 192 P

[56] References Cited

U.S. PATENT DOCUMENTS

| | | | |
|---|---|---|---|
| 3,043,684 | 7/1962 | Mayer | 96/1.4 |
| 3,124,483 | 3/1964 | Rheinfrank | 96/1.4 |
| 3,592,642 | 7/1971 | Kaupp | 96/1.4 |
| 4,025,339 | 5/1977 | Kuehnle | 96/1.5 |

OTHER PUBLICATIONS

Lagnado et al. RF Sputtered CdS–Thin Crystals pp. 318–321, J. of Vacuum Sci. & Tech. Mar., 1970.

*Primary Examiner*—Travis Brown
*Attorney, Agent, or Firm*—Silverman, Cass & Singer, Ltd.

[57] ABSTRACT

A method for obtaining multiple copies from apparatus including an electrophotographic member of the type in which the latent image is represented by charge not removed when toner is applied and thereafter transferred. The electrophotographic member with its latent image is repeatedly subjected to toning and transfer to respective multiple receptors without intervening charge and exposure. This may be done until the desired number of copies is made or until the image quality deteriorates by reason of dark decay. If additional copies are desired the electrophotographic member is again charged and exposed and thereafter toned and the image transferred repeatedly without intervening additional charge and exposure.

Apparatus for effecting the method above and providing structure for carrying out the described steps include other functions such as automatically sensing quality and responding to a condition which requires a new cycle of charge and expose.

5 Claims, 3 Drawing Figures

MULTIPLE COPY ELECTROPHOTOGRAPHIC REPRODUCING METHOD

This is a continuation, of application Ser. No. 723,098 filed Sept. 14, 1976 which in turn was a continuation of Ser. No. 517,173 filed Oct. 23, 1974, both now abandoned.

CROSS REFERENCE TO RELATED APPLICATIONS

Reference is made herein to an electrophotographic member which is disclosed and claimed in copending U.S. Application Ser. No. 434,699 filed Jan. 18, 1974 and entitled "Electrophotographic Film, Method of Making and Using the Same and Photoconductive Coating Used Therewith", now abandoned in favor of U.S. Continuation Application Ser. No. 704,780, filed July 13, 1976 and entitled "Electrophotographic Film, Method of Making the Same and Photoconductive Coating Used Therewith", now U.S. Pat. No. 4,025,339. The said copending application is owned by the assignee of this application.

BACKGROUND OF THE INVENTION

The invention is concerned generally with so-called copying machines on a method in which the same subject matter, such as for example a document, is to be repeated in multiple copies. Specifically, the invention relates to such copying machines which utilize the electrostatic principles of imaging.

Two types of presently used electrostatic copying machines are in general use, one operating on the basis of xerography and the other on the basis of that which is known as electrofax. The first type of device provides an electrophotographic member in the form of an amorphous selenium drum based upon metal, the selenium surface being charged, exposed to an image, toned and the toned image transferred to a receptor which usually consists of ordinary paper. After transfer, the image is fused to the paper by a heat lamp. The second type of device provides an electrophotographic member in the form of a sheet of conductive paper carrying a coating of zinc oxide in a resin matrix, the coating being charged and exposed to projected image after which the entire electrophotographic member is moved through a liquid toner bath and fused in the latter step of which it is dried. The entire member becomes the copy of the document or article which was copied.

In both cases, when multiple copies are required, the apparatus recycles, passing through the functions of charge, expose and tone. In the case of the xerographic apparatus the electrophotographic member is caused to transfer the toned image to the receptor, the receptor is fused and dispensed into a bin, the member is cleaned and discharged and the mechanism starts all over again to charge, expose, tone, etc. In the case of the electrofax apparatus, obviously since the copy is the electrophotographic member itself, the machine must go through the complete cycle from the very beginning and through to the dispensing of the toned electrophotographic member for each copy.

Although this invention is concerned only with apparatus and a method in which there is a transfer of toner effected, both types of electrophotographic members will be discussed as a group and contrasted with a different type of electrophotographic member.

The charge which is placed upon the surface of the known type of electrophotographic member as used in the xerographic and electrofax apparatus is selectively dissipated by the light which is projected onto the surface to form the latent image, leaving a latent image of primarily positive charges in the first case and negative charges in the second case. When toned by applying the fine particles of suitably polarized carbons, resins, etc. constituting modern toners, the toner particles neutralize or absorb the charges constituting the latent image. If these particles are removed mechanically, as by transfer to a receptor, substantially no charge of any consequence remains on the surface of the electrophotographic member. Either the toning neutralizes the charge or absorbs it, probably the former.

Using this type of electrophotographic member it is seen that known electrostatic copying machines must be complex and expensive, must have expensive, long duty cycles and must have slow throughputs. The rate of reproduction is limited by the length of a complete duty cycle.

The invention contemplates the use of an electrophotographic member in which the charge applied thereto is not believed to reside on the surface but is believed to exist at or below the surface without in any way adversely affecting the surface effects of the charge. Such an electrophotographic member is of the type which is disclosed in the copending application and includes a crystalline, dense, inorganic photoconductive coating of a thin film semiconductor material applied by sputtering to a suitable ohmic layer and substrate and used to make multiple copies as described below. Since there are believed to be no charges sitting on the surface, there can be no neutralization of such charges by toner particles applied thereto and thereafter removed therefrom. The charge and hence the latent image will obtain so long as the quality thereof does not deteriorate on account of the characteristic dark decay of the coating. Until this deterioration is obvious in copies produced, the latent image once formed can be toned and transferred repeatedly without the need for again charging and exposing so that many copies can be made quickly on only one exposure.

Advantages accrue because of the fact that one charge and exposure will provide a great many copies at high speed. The duty cycle during the copy making period of time consists only of toning and transferring.

Many other advantages will occur to those in this art as a result of consideration of the detailed description hereinafter.

SUMMARY OF THE INVENTION

A method of producing multiple copies from an electrophotographic member having a photoconductive coating of the type which will not lose charge to toner particles applied to the coating. The method comprises charging the coating with a suitable source of positive or negative ions to produce a uniform charge at or below the surface of the coating, exposing the coating to radiation from an object to achieve a latent image of said object in said charge through selective internal dissipation or recombination of parts of said uniform charge, applying toner particles to said surface and transferring the resulting toned image to a receptor and thereafter repeating the toner application and transfer without charging and exposing to achieve a plurality of copies. The method may be continued until deterioration of the transferred image due to dark decay of the photoconductive coating, if desired, or may be furthered by subsequent charging and exposing followed by another group of multiple copies and so on.

The apparatus of the invention comprises means for charging, exposing, toning and transfer to a receptor in which there are means to continue operation of only the toning and transfer means of the apparatus. Likewise means may be provided to enable the renewal of the charging and exposing, if desired, between groups of copies made only by toning and transfer. Structure may be provided for the various functions needed such as paper supply and feed in synchronism with the apparatus, control of the charge and exposure means, etc. Means may be provided for sensing quality of the images transferred and causing the operation of the charge and exposure means from time to time between groups of copies made only by toning and transfer.

DESCRIPTION OF THE PREFERRED EMBODIMENTS

The invention revolves around the use of an electrophotographic member which has a photoconductive coating that does not lose charge to toner. In such a member, the charge produces a field or what may be considered an enormous number of fields on the surface of the photoconductive coating having the same action as the type of photoconductive coatings in which the charge produces ions that sit on the surface. This action comprises the attraction of suitably polarized toner particles. When the toner particles are removed from the type of coating in which ions sit on the surface, there is no longer an integrated charge remaining on the surface. On the other hand, when the toner particles are removed from the photoconductive coating that has the charge at or below the surface, the charge is not affected. Accordingly, such charge on the latter type of coating, whether it is a uniform charge or is represented by a latent image of an object being copied, will persist irrespective of the number of times it is toned and the toner removed until the quality of the image deteriorates due to the dark decay characteristic of the coating. This latter is not a function of the application or removal of toner particles but is a physical concept inherent in the coating itself.

The electrophotographic member and coating which is disclosed in the copending application is ideally suited for the invention herein. The photoconductive coating is a thin film, microcrystalline, inorganic, dense, sputtered semiconductor material and is believed to produce anisotropy of a remarkable nature. The crystallites forming the coating are orthogonally oriented relative to the substrate and are thus believed to produce a practically infinite number of individual fields at their apices on the surface. The constitution of the coating is such that the charge applied thereto is believed to enter into the coating and be trapped in suitable locations therein, being neutralized or caused to recombine only by radiation during exposure and not by surface contact with charged toner particles. When the toner particles are removed as by transfer the charged increments are not affected; hence the same latent image still remains and may be again toned and transferred over and over again many times without re-charging and re-exposing.

Figure 2:
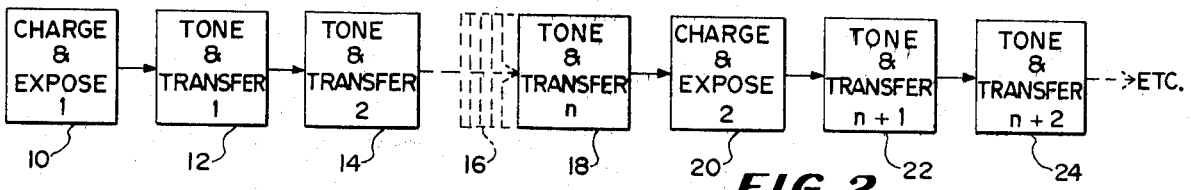
FIG. 2 is a block diagram showing by way of progression the steps constituting generally the method of the invention.

The method of the invention is explained briefly in connection with FIG. 2 which shows a series of blocks representing a flow chart of steps from left to right. Block 10 represents two steps combined in order to render the diagram easy to follow. Actually these two steps are normally preferred seriatim with the electrophotographic member being first charged by corona or the like and thereater being exposed to the illumination produced by projecting the image of an object onto the electrophotographic member, that is, onto the photoconductive coating thereof. Thus block 10 is called "Charge & Expose". The next following block 12 is marked "Tone & Transfer - 1" this being the next two following steps in the production of a copy of the object. The surface of the photoconductive coating is toned either by dry or liquid toner which adheres in accordance with the latent charge image and thereafter a receptor member such as a sheet of paper is pressed against the coating and it picks up the toner to transfer the toned visible image to the surface of the paper.

In some methods there may be a fusing or fixing step thereafter but in other instances the toner may be suspended in a solvent which readily evaporates and leaves the toned image self-adhering without the need for fixing. The invention contemplates both types of toner and for simplicity no fixing step is referred to in the diagram of FIG. 2. It is presumed to be there if needed. In such case it would follow after the block 12.

In the known systems and methods such as exemplified by xerography the next step following the tone and transfer represented by block 12 would have to be again charge and expose if one wanted multiple copies. Each copy would go through the same duty cycle, requiring energizing of the high voltage corona circuit, operation of the optical mechanism and energization of the projector lamp and circuit. In addition, the mechanical apparatus needed to return mechanisms to initial positions at the beginning of the procedure could be complex. Thus, blocks 10 and 12 so far as described above are known. The only difference between the prior art and the invention is represented by the numeral "1" in the blocks 10 and 12.

The presence of the numeral "1" in blocks 10 and 12 is intended to signify that the pair of steps of block 12 will produce the first copy from the first pair of steps of block 10. The next block is 14 and again it is designated "Tone and Transfer" but this block is marked by the numeral "2". What this means is that immediately after the image has been transferred in block 12 it is again toned and the second image transferred to another receptor. This has been done out of the same first latent image achieved through the charge and expose steps of block 10.

The same two steps of tone and transfer are repeated over and over again, as indicated by the broken lines at 16 until the user decides he has enough copies. The last copy is then produced by the block 18 which is marked "Tone & Transfer - n", meaning that n copies have been made. If there has been no substantial decay of the charge due to the inherent dark decay characteristic of the electrophotographic member when the nth copy has been produced, the process may be stopped at the block 18. If on the other hand the user wants more copies than he has made by the process described and in his judgment, or in the judgment of a suitable densitometer measuring the copies it appears that copies after the nth will not be acceptable, he may again charge and image the electrophotographic member (block 20) and following that tone and transfer as described above (blocks 22 and 24). This may go on as long as desired.

It is noted that the blocks 22 and 24 are marked "Tone & Transfer - n+1" and "Tone & Transfer -n+2". The block 18 is marked "Charge and Expose -2". The significance of this is that the number of copies which follow after the nth copy will be n+1, n+2, etc., but the group thus identified will be the second group, deriving from the first renewal of the charge and exposure which, of course, is the second such charge and exposure. This may continue so long as desired.

The requirements for apparatus for carrying out the method described above may be very simple and economical. They may be achieved in fully or partially automatic apparatus and may be arranged for linear movement or rotary movement. The apparatus may, if desired, be quite sophisticated.

Figure 1:
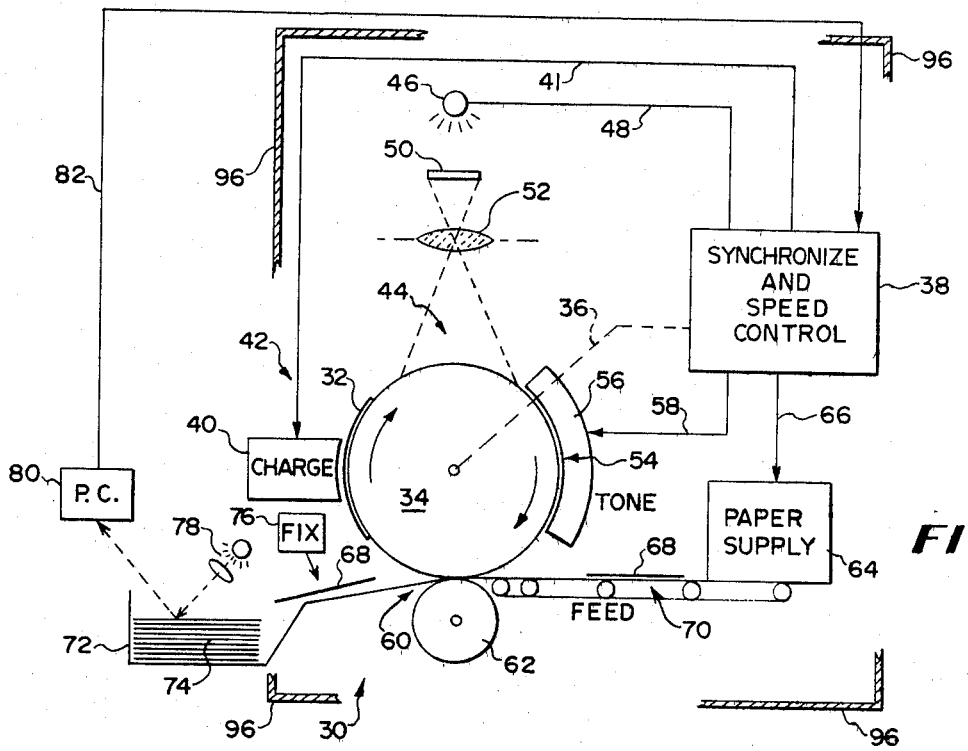
FIG. 1 is a highly schematic view and block diagram combined, showing apparatus of the invention capable of carrying out the method thereof.

In FIG. 1 there is diagrammed in a highly simplified form a rotary type of apparatus 30 for carrying out the invention. The electrophotographic member 32 is mounted on a suitable rotary cylinder 34 driven by some rotational mechanism at a controlled speed. This is indicated by the broken line 36 which extends to the block 38. Block 38 is marked "Synchronize and Speed Control" and as will be seen it represents controls and circuitry, manual, automatic or a combination thereof. It can represent power sources, drive and speed devices, etc. This type of apparatus is readily worked out by those skilled in the art in accordance with the functions desired which will be explained.

A charge device 40 operated through the channel 41 from the control or programmer 38 is disposed on the left of the cylinder 32 and charges the member 32 as the cylinder rotates in a clockwise direction indicated by the arrows. The charging may be done at what may be termed a charging station 42 and from this station the member 32 is carried around to the top of the cylinder 34 to the exposure station 44. Here a suitable light source 46 energized through the channel 48 illuminates an object 50 which in this case may comprise a transparency of a scene or document. The projected material is passed through a suitable optional train 52 and illuminates the charged surface of the electrophotographic member 32 at the proper timed relationship when the member 32 arrives at the exposure station. The resulting latent image may be applied by momentarily stopping the cylinder 34 or by suitable rocking mechanisms and optics which apply the image during movement of member 32 past the exposure station 44.

The now-exposed member 32 moves to the toning station 54 at which there is a toning mechanism 56 controlled from the control or programmer 38 by way of the channel 58. After toning, the member 32 is rotated down to the transfer station 60 at which point a back-up roller 62 is located. A paper supply 64 synchronized in operation through the channel 66 is arranged to feed a receptor such as a sheet of paper 68 along the paper feed 70 into the nip between the back-up roller 62 and the cylinder 34 just at the time that the toned member 32 arrives at the nip. As the paper member 68 goes through the nip the toned image is transferred to the paper surface and the completed paper copy falls into the bin 72. A stack of copies is shown at 74. If needed, fusing or fixing may be effected at 76, while the paper copy is on its way to the bin 72 or even in the bin.

The member 32 is now rotated around past the charging station 42 and the exposure station 44 but in the meantime, the control device 38 has deenergized the charging device 40 and the projecting lamp 46 (as well as any associated mechanisms) so that the toning station is reached without anything being done to the member 32. The toning mechanism 56 is operated, the toned image transferred to the next sheet of paper 68 and the partial duty cycle (i.e., without charging and exposing) is repeated again and again. Since there need be no steps other than tone and transfer, the control device 38 may automatically increase the speed of rotation of the cylinder 34 and synchronize operation of the toning mechanism 56 and paper feed 70 to suit.

The production of copies may continue until the user sees that the quality has deteriorated. He may stop the machine if he has sufficient copies before this occurs; he may manually operate the control device to restart the charge mechanism 40 and the exposure mechanism and lamp 46 so that he can commence a second series of copies; or he may do the latter automatically.

In the latter event, a densitometer represented by the spot projector 78 and photoresponsive device 80 (such as a photocell) is arranged to monitor the copies in the bin 72. When the density of the copied image deteriorates to produce a signal (or absence of signal) when compared with some adjustable standard (not shown) through the channel 82, the control mechanism 38 may be arranged to cause charge and exposure of the member 32 for one revolution only.

Other variations are readily worked out for modifications for different needs of a copying apparatus.

Figure 3:
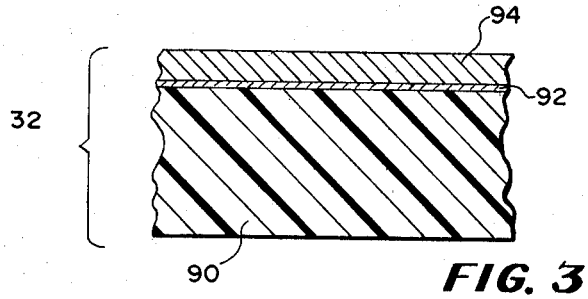
FIG. 3 is a fragmentary sectional view on a highly exaggerated scale of an electrophotographic member suitable for use with the invention.

FIG. 3 shows the electrophotographic member of the type disclosed in the copending application which is ideally suited for use as the member 32. There is a substrate 90 which is of a synthetic resin (Mylar - Dupont) about 0.005 inch thick having an ohmic layer of tin-indium oxide 92 sputtered thereon of a thickness of several hundred Ångstroms. Upon this ohmic layer 92 is a dense, microcrystalline, sputtered coating 94 of cadmium sulfide about 2500 to 5000 Ångstroms thick. The cadmium sulfide comprises the photoconductive coating of the type described above and is one of several examples of inorganic, thin film coatings that will produce the characteristics mentioned. The principal characteristic so far as this invention is concerned is the ability to hold charge at or below the surface of the coating rather than sitting on the surface so that toner particles applied and removed will not substantially affect the charge.

Obviously the steps of the invention are best carried out in darkness to delay dissipation of charge by any means other than inherent dark decay. Shrouds for the apparatus are presumed and are symbolically represented at 96. The reference to "ambient light" means external light not including the exposure means 44.

The particular electrophotographic member 32 described can be toned and transferred in about a second or less time. Once the photoconductive coating 94 has been charged and imaged (which may require about half a second or less) the copies can be made at a rate of about one a second. If the duty cycle included charge and expose, the cylinder could rotate at about one revolution every two seconds, but since the charge station 42 and exposure station 44 are not used during the making of repeat copies, the rate of rotation of the cylinder 34 can be doubled. These exact figures for speed and rates are only by way of example and are subject to wide variation. The number of copies made from a single exposure can be from several to hundreds, depending on the materials, toners, etc.

As indicated previously, the operation of the apparatus and method may be carried out using a linearly moving mounting for the electrophotographic member 32. In such case there would be a carriage which reciprocates relative to the several stations, but does not return to the charging and exposure stations when in the repeat mode. Thus, assuming that the stations follow one another along a line, the reciprocal path of the carriage is half as long in the repeat mode as in the original full cycle mode.

Arrangements can be made in which the electrophotographic member is fixed and the apparatus carries the stations relative to it. Likewise, the electrophotographic member could be moved in a cycle which is both rectilinear and rotary, as for example, on an endless recycling belt.

The receptor can be any suitable article to which the toned image can be transferred, but normally it will be a sheet of paper. It could be a long roll or ribbon of paper which may or may not be cut into individual members either before or after transport. The paper supply may be a stack of sheets fed off one at a time. Other variations are feasible.

What it is claimed and desired to secure by Letters Patent of the United States is:

1. A method of producing electrostatically multiple copies of an object being imaged on the photoconductive coating of an electrophotographic member which comprises:

(a) providing an electrophotographic member having a substrate with a photoconductive coating comprising an r.f. sputtered thin film, microcrystalline, wholly inorganic, dense, semiconductor material wherein the crystallites forming the coating are generally orthogonally oriented relative to the substrate, the coating having a dark resistivity of at least $10^{12}$ ohm-centimeters and a ratio of dark and light resistivity of at least $10^4$ and being electrically anisotropic, the coating at least being capable of accepting a charge and holding said charge at or below the surface to the extent that the latent image which is capable of being achieved thereat is substantially unaffected by toner development or transfer, (b) charging the coating only from the coating side of said member with a uniform charge at or below the surface of the coating and holding the charge thereat, (c) exposing the charged coating immediately following the completion of charging, to a projected image of the object to achieve a latent charge image with the charge at or below the surface of the coating, (d) toning the coating to achieve a visible toned image, (e) transferring the toned image to a receptor to achieve a copy of the projected image, (f) repeating steps (d) and (e) for at least another time to provide at least a second copy of the projected image, but without repeating steps (b) and (c), all of the steps of charging, exposing, toning and transferring being carried on without exposing the coating to ambient light, and the steps of at least (c) exposing and (e) transfer being effected for plural copies without further charging to establish electric fields, the toning and transferring being effected while substantially maintaining the charge relationship and magnitude thereof along the dark decay curve characteristic of said photoconductive coating whereby the step at least of transfer is effected for plural copies without heating or requiring supplementation of the fields representing the latent image.

2. The method as claimed in claim 1 in which the repeat is continued to make additional copies on additional receptors until before the average density of the most recent copy on a receptor is less than a predetermined value.

3. The method as claimed in claim 2 in which the charging and exposing are repeated once only after the production of said most recent copy on a receptor and thereafter only toning and transfer are effected to achieve further copies on receptors.

4. The method as claimed in claim 1 in which each copy is fixed after transfer.

5. The method as claimed in claim 1 in which said photoconductive material is selected from the group consisting of cadmium sulfide, zinc sulfide and mixtures of zinc sulfide and cadmium sulfide.

* * * * *